US005901785A

United States Patent [19]

Chiba et al.

[11] Patent Number: 5,901,785

[45] Date of Patent: May 11, 1999

[54] HEAT EXCHANGER WITH A DISTRIBUTION DEVICE CAPABLE OF UNIFORMLY DISTRIBUTING A MEDIUM TO A PLURALITY OF EXCHANGER TUBES

[75] Inventors: Tomohiro Chiba; Toshiharu Shinmura, both of Sawa-gun, Japan

[73] Assignee: Sanden Corporation, Gunma, Japan

[21] Appl. No.: 08/825,378

[22] Filed: Mar. 28, 1997

[30] Foreign Application Priority Data

Mar. 29, 1996 [JP] Japan ..... 8-076236

[51] Int. Cl.[6] ..... F28F 9/22

[52] U.S. Cl. ..... 165/174; 165/153; 165/DIG. 465; 165/DIG. 483; 62/525

[58] Field of Search ..... 165/153, 174; 62/525

[56] References Cited

U.S. PATENT DOCUMENTS

| | | | |
|---|---|---|---|
| 2,044,455 | 6/1936 | Witzel | 165/174 X |
| 2,099,186 | 11/1937 | Anderegg . | |
| 3,976,128 | 8/1976 | Patel et al. | 165/153 |
| 4,153,106 | 5/1979 | Sonoda et al. | 165/174 |
| 4,458,750 | 7/1984 | Huber | 165/174 |

FOREIGN PATENT DOCUMENTS

| | | | |
|---|---|---|---|
| 1015443 | 9/1952 | France . | |
| 1128148 | 1/1957 | France . | |
| 2194927 | 3/1974 | France . | |
| 3-260566 | 11/1991 | Japan | 62/525 |
| 3-260567 | 11/1991 | Japan | 62/525 |
| 2250336 | 6/1992 | United Kingdom . | |

*Primary Examiner*—Allen Flanigan
*Attorney, Agent, or Firm*—Baker & Botts, L.L.P.

[57] ABSTRACT

In a heat exchanger (1) including first through M-th tube groups, each tube group comprising at least one exchanger tube (10), and a distribution device (3) which has a distribution tank (30) supplied with a medium and first through M-th distribution paths (31, 32, and 33) for directing the medium from the distribution tank to the first through the M-th tube groups, respectively, medium inlet ports of the first through the M-th distribution paths are coupled to first through M-th regions of the distribution tank that have first through M-th void ratios different to each other. Medium outlet ports of the first through the M-th distribution paths are coupled to the exchanger tubes of the first through the M-th tube groups, respectively. The number of the exchanger tubes of each of the first through the M-th tube groups and an inner cross-sectional area of each of the first through the M-th distribution paths are defined on the basis of the first through the M-th void ratios of the first through the M-th regions of the distribution tank so that a mass flow of the medium introduced into one of the exchanger tubes of the first through the M-th tube groups is substantially equal to the mass flow of the medium introduced into each of remaining ones of the exchanger tubes of the first through the M-th tube groups.

7 Claims, 8 Drawing Sheets

HEAT EXCHANGER WITH A DISTRIBUTION DEVICE CAPABLE OF UNIFORMLY DISTRIBUTING A MEDIUM TO A PLURALITY OF EXCHANGER TUBES

BACKGROUND OF THE INVENTION

This invention relates to a heat exchanger with a distribution device for uniformly distributing a medium to a plurality of exchanger tubes.

Generally the efficiency of a heat exchanger is affected not only by heat transfer of an outer fluid flowing outside of a plurality of tubes of the heat exchanger but also by heat transfer of an inner fluid flowing inside of the tubes. In particular, flow distribution of the inner fluid has a great influence. By way of example, consideration will be made about an evaporator as the heat exchanger. A mixed-phase refrigerant as a mixture of a gas-phase refrigerant and a liquid-phase refrigerant is introduced into a plurality of tubes of the evaporator. Due to the difference in inertial force, the gas-phase and the liquid-phase refrigerants are not uniformly distributed in the mixed-phase refrigerant supplied to the evaporator. In other words, the mixed-phase refrigerant inevitably has different void ratios at various points in a flow path. In the present specification, a void ratio is defined as a ratio of the volume of the gas-phase refrigerant to the volume of the mixture of the gas-phase and the liquid-phase refrigerants. Under the circumstances, the liquid-phase refrigerant is concentrated to a particular tube while the gas-phase refrigerant is concentrated to another tube. This brings about nonuniform temperature distribution within the evaporator. As a result, the efficiency of the heat exchanger is deteriorated.

For example, a conventional heat exchanger is disclosed in Japanese Unexamined Patent Publication (JP-A) No. 155194/1992. In the conventional heat exchanger, however it is impossible to uniformly distribute the refrigerant to a plurality of exchanger tubes, as will later be described.

SUMMARY OF THE INVENTION

It is therefore an object of this invention to provide a heat exchanger with a distribution device capable of uniformly distributing a medium to a plurality of exchanger tubes.

Other objects of this invention will become clear as the description proceeds.

A heat exchanger to which this invention is applicable comprises: first through M-th tube groups, each tube group comprising at least one exchanger tube, where M represents an integer greater than one; and a distribution device comprising a distribution tank supplied with a mixed-phase medium consisting essentially of a gas-phase medium and a liquid-phase medium and first through M-th distribution paths for directing the mixed-phase medium from the distribution tank to the first through the M-th tube groups. Each of the first through the M-th distribution paths have a medium inlet port and a medium outlet port.

According to this invention, the medium inlet ports of the first through the M-th distribution paths are coupled to first through M-th regions of the distribution tank, respectively. The first through the M-th regions have first through M-th void ratios, respectively, which are different to each other, where each void ratio is defined as a ratio of the volume of the gas-phase medium present in each region of the distribution tank to the volume of both the gas-phase medium and the liquid-phase medium present in each region of the distribution tank. The medium outlet ports of the first through the M-th distribution paths are coupled to the exchanger tubes of the first through the M-th tube groups, respectively. The number of the exchanger tubes of each of the first through the M-th tube groups and an inner cross-sectional area of each of the first through the M-th distribution paths are defined on the basis of the first through the M-th void ratios of the first through the M-th regions of the distribution tank so that a mass flow of the mixed-phase medium introduced into one of the exchanger tubes of the first through the M-th tube groups is substantially equal to the mass flow of the mixed-phase medium introduced into each of remaining ones of the exchanger tubes of the first through the M-th tube groups.

Preferably, the number of the exchanger tubes of an m-th tube group increases in inverse proportion to an m-th void ratio of an m-th region when the inner cross-sectional areas of the first through the M-th distribution paths are substantially equal to each other, where m is variable between 1 and M, both inclusive.

Alternatively, the inner cross-sectional area of an m-th distribution path increases in direct proportion to an m-th void ratio of an m-th region when the number of the exchanger tubes of one of the first through the M-th tube groups is substantially equal to the number of the exchanger tubes of remaining ones of the first through the M-th tube groups, where m is variable between 1 and M, both inclusive.

Generally, the number of the exchanger tubes of an m-th tube group and the inner cross-sectional area of an m-th distribution path is defined in accordance with an expression:

$$g=G\times(AP_m/AP_0)\times(1/\alpha_m)\times(1/N_m),$$

where g represents the mass flow of the mixed-phase medium introduced into each of the exchanger tubes of the first through the M-th tube groups; G representing a total mass flow of the mixed-phase medium introduced into the exchanger tubes of the first through the M-th tube groups; $AP_m$ representing the inner cross-sectional area of the m-th distribution path; $AP_0$ representing a total sum of the inner cross-sectional areas of the first through the M-th distribution paths; $\alpha_m$ representing an m-th void ratio of an m-th region, $N_m$ representing the number of the exchanger tubes of the m-th tube group; and where m is variable between 1 and M, both inclusive.

In the heat exchanger, at least one of the first through the M-th distribution paths may comprise a plurality of partial distribution paths which have partial medium inlet ports coupled to a corresponding one of the first through the M-th regions of the distribution tank in common and partial medium outlet ports coupled to a corresponding one of the first through the M-th tube groups in common. In this case, a total sum of inner cross-sectional areas of the plurality of partial distribution paths is substantially equal to the inner cross-sectional area of the above-mentioned at least one of the first through the M-th distribution paths.

In this invention, one ends (medium inlet ports) of the distribution paths (may have various structures such as pipes and holes and are therefore collectively called distribution paths) are coupled to the different regions in the distribution tank of the distribution device which have different void ratios (the number of the distribution paths coupled to each region is not restricted to one but may be a plural number.

Consideration will be made about the case where the inner cross-sectional area of the distribution path coupled to the region of a small void ratio is selected to be substantially equal to that of the distribution path coupled to the region of a large void ratio. In this event, the mass flow of the medium flowing through the distribution path coupled to the region of the small void ratio is great as compared with the distribution path coupled to the region of the large void ratio. In order to introduce an equal mass flow of the medium into each tube, it is necessary to increase the number of the tubes communicating with the distribution path coupled to the region of the small void ratio. For this purpose, a tank of the heat exchanger is divided into a plurality of chambers so that the tubes are separated into the plurality of tube groups communicating with the respective chambers. Each chamber is connected to the distribution path each of which is coupled to one of the regions. Specifically, the distribution path coupled to the region of the small void ratio is connected to the chamber communicating with a large number of the tubes while the distribution path coupled to the region of the large void ratio is connected to the chamber communicating with a small number of the tubes. In this manner, the mass flow supplied to the respective tubes is rendered uniform. In the region of the small void ratio, the medium is abundant with the liquid phase. Therefore, the medium can be uniformly supplied to the large number of the tubes communicating with the chamber connected to the region through the distribution path.

On the contrary, in case where the number of the tubes communicating with each chamber is same, the mass flow in the distribution path coupled to the region of the small void ratio must be equal to that of the distribution path coupled to the region of the large void ratio. To this end, the inner sectional area of the distribution path coupled to the region of the small void ratio must be smaller than that of the distribution path coupled to the region of the large void ratio. With this structure, an equal mass flow of the medium is introduced into each distribution path. As a result, the medium is uniformly supplied to the respective tubes.

DESCRIPTION OF THE PREFERRED EMBODIMENTS

In order to facilitate an understanding of this invention, description will at first be made about conventional heat exchangers with reference to FIGS. 1 through 4.

Figure 1:
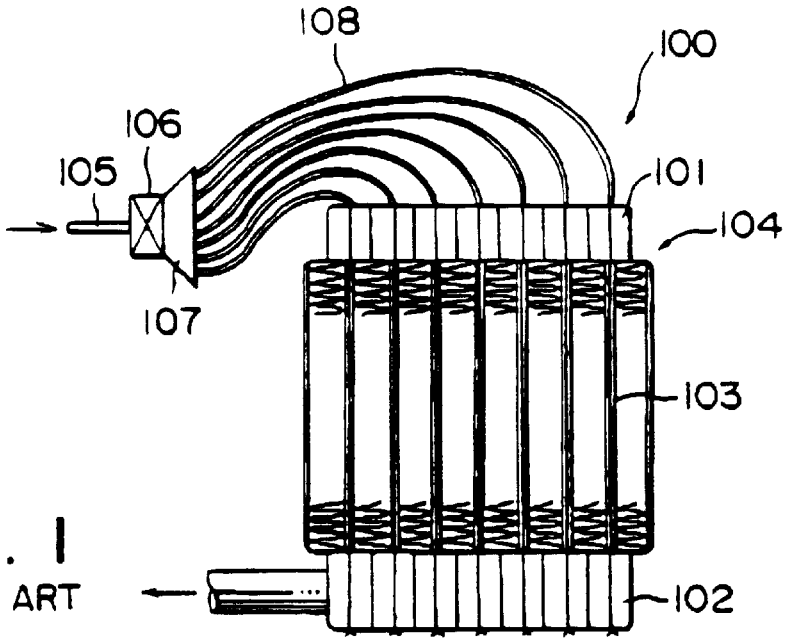
FIG. 1 PRIOR ART
FIG. 1 is a front view of a first conventional heat exchanger.

Referring to FIG. 1, a conventional evaporator 100 with a distribution device comprises a stack of a plurality of fluid passage tubes 104. Each tube 104 has a pair of tank portions 101 and 102 for distribution and collection of a refrigerant and a tube portion 103 for fluid communication between the tank portions 101 and 102. A combination of a plurality of the tank portions 101 forms an entrance tank at an upper end of the evaporator 100 while a combination of a plurality of the tank portions 102 forms an exit tank at a lower end of the evaporator 100. A refrigerant introduction pipe 105 for introducing a refrigerant into the evaporator 100 has one end connected to a throttle portion 106. The throttle portion 106 is coupled to a distribution tank 107 connected to a plurality of distribution pipes (distribution paths) 108. The distribution pipes 108 are coupled to the tank portions 101 to communicate with the tubes 104 in one-to-one correspondence. In the above-described conventional evaporator, a combination of the throttle portion 106, the distribution tank 107, and the distribution pipes 108 forms the distribution device. The distribution device aims to uniformly distribute the refrigerant to the respective tubes 104.

In the above-described evaporator, a large number of the distribution pipes are connected so that a complicated fitting operation and a large layout space are required. In order to facilitate the fitting operation and to reduce the layout space, the above-mentioned Japanese Unexamined Patent Publication (JP-A) No. 255194/1992 discloses various modifications in which a multihole pipe 109 as a single distribution pipe is arranged in the entrance tank of the heat exchanger 100, as illustrated in FIGS. 2 through 4.

In the conventional evaporator illustrated in FIG. 1, the refrigerant passing through the throttle portion has a gas/liquid mixed phase in the distribution tank and can not be uniformly distributed to the distribution pipes which are simply connected to the distribution tank without any special consideration.

Figure 2:
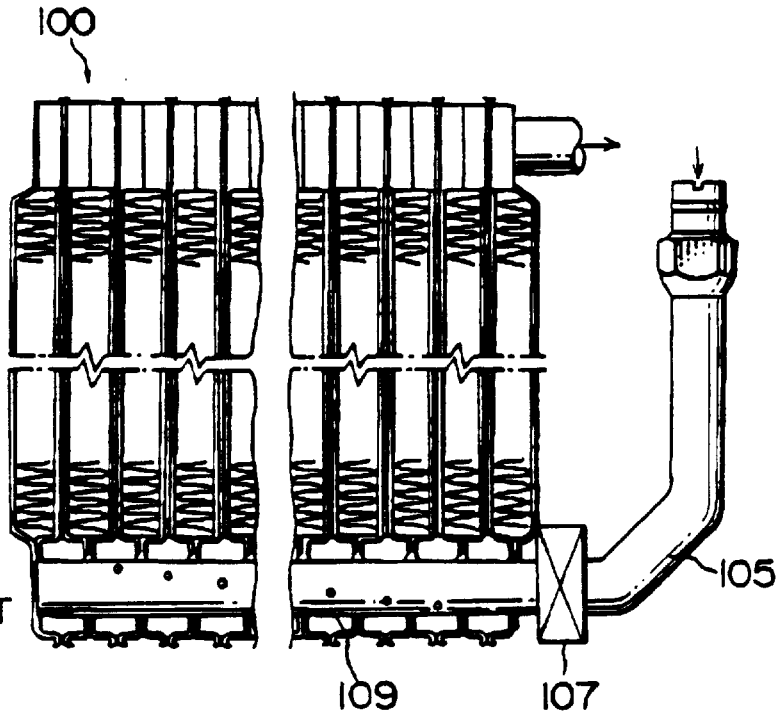
FIG. 2 PRIOR ART
FIG. 2 is a front view of a second conventional heat exchanger.
Figure 3:
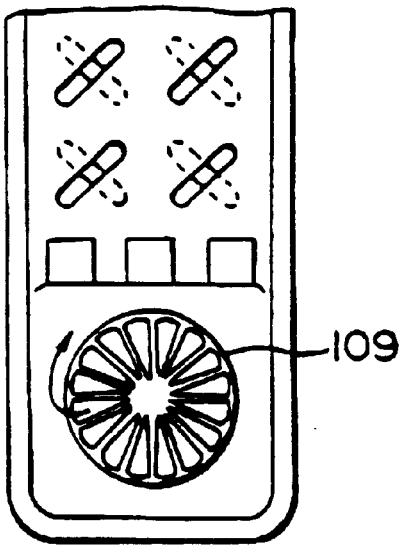
FIG. 3 PRIOR ART
FIG. 3 schematically shows a characteristic portion of a third conventional heat exchanger.
Figure 4:
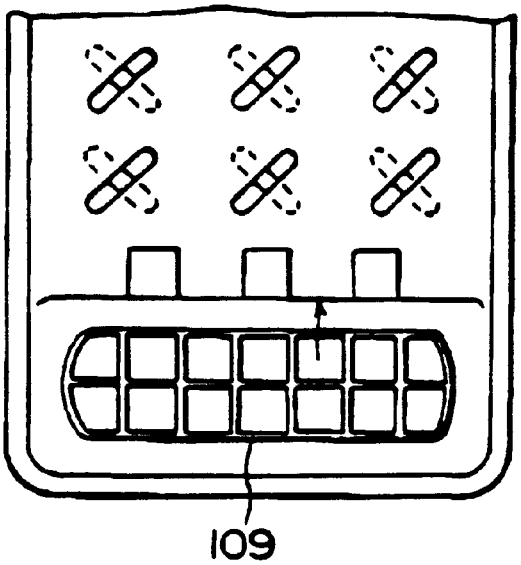
FIG. 4 PRIOR ART
FIG. 4 schematically shows a characteristic portion of a fourth conventional heat exchanger.

On the other hand, the conventional evaporators illustrated in FIGS. 2 through 4 are effective to simplify the fitting operation and to reduce the layout space. However, uniform distribution of the refrigerant to the tubes can not be achieved unless the refrigerant is uniformly introduced into the multihole pipe 109. The above-referenced Japanese publication makes no reference to an arrangement for uniformly introducing the refrigerant into the multihole pipe.

Now, description will be made about several preferred embodiments of this invention with reference to the drawing.

Figure 5:
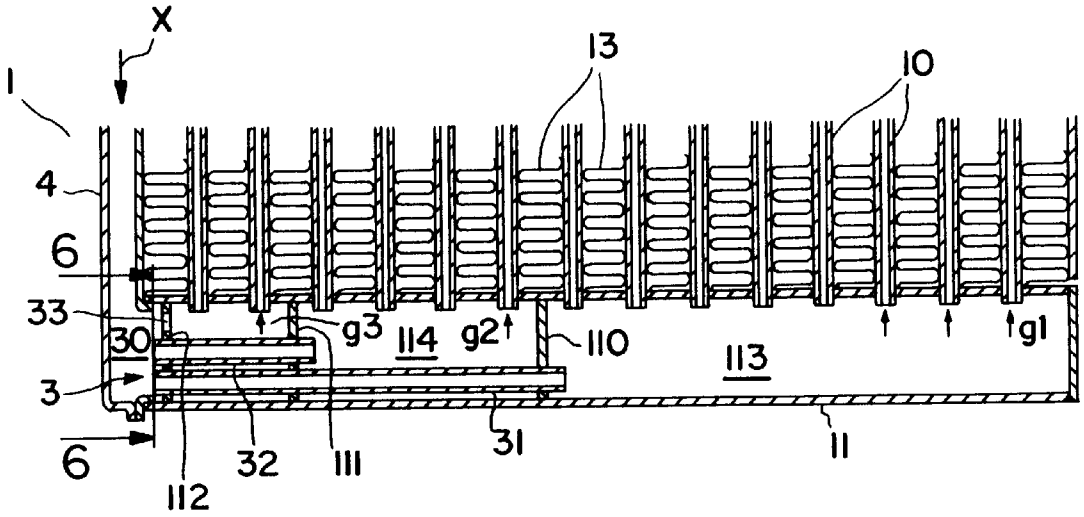
FIG. 5 is a sectional view of a heat exchanger according to a first embodiment of this invention.

At first referring to FIGS. 5 through 8, a heat exchanger 1 according to a first embodiment of this invention will be described. In FIG. 5, an arrow X represents a direction along which a medium is introduced into the heat exchanger 1. The heat exchanger 1 comprises a plurality of tubes (exchanger tubes) 10, an entrance tank 11, an exit tank (not shown in the figure because it is arranged behind in parallel to the entrance tank 11), and a plurality of fins 13.

Figure 8:
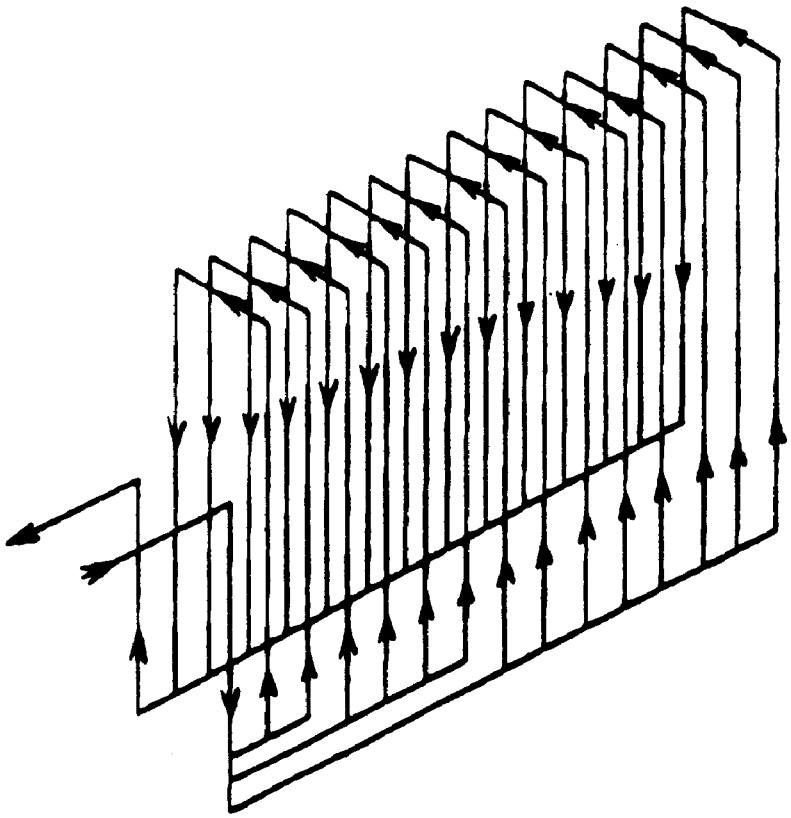
FIG. 8 is a view for describing the flow of a medium in the heat exchanger illustrated in FIG. 5.

Each of the tubes 10 has a generally U-shaped refrigerant path formed inside. The tubes 10 are coupled to the entrance tank 11 and the exit tank at a predetermined interval. Specifically, each tube 10 has one lower end connected to the entrance tank 11 and the other lower end connected to the exit tank. Thus, a refrigerant path illustrated in FIG. 8 is formed.

The entrance tank 11 is divided by first through third partition plates 110, 111, and 112 into first through third chambers 113, 114, and 115, respectively. Accordingly, the tubes 10 are separated into first through third tube groups connected to the first through the third chambers 113, 114, and 115, respectively. In the illustrated example, the first through the third tube groups comprise eight, four, and two tubes 10, respectively.

The entrance tank 11 is provided with a distribution device 3. The distribution device 3 comprises a distribution tank 30 and first through third distribution paths 31, 32, and 33. The distribution tank 30 is defined as a cavity between the entrance tank 11 and a refrigerant introduction tank 4 which will later be described.

Figure 6:
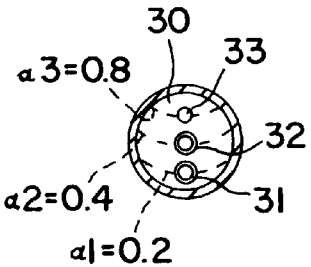
FIG. 6 is a sectional view taken along a line A—A in FIG. 5.

Referring to FIG. 6, the distribution of the void ratio within the distribution tank 30 will be described. The flow of the medium in the direction X causes the distribution of the void ratios because of the difference in inertial force acting on a liquid-phase medium and a gas-phase medium as described in the preamble of the specification. As depicted by dashed lines in the figure, first through third regions in the distribution tanks 30 have first through third void ratios a $\alpha_1$, $\alpha_2$, and $\alpha_3$ equal to 0.2, 0.4, and 0.8, respectively. It is noted here that each dashed line represents the center of each region.

Turning back to FIG. 5 with FIG. 6 continuously referred to, the first distribution path 31 penetrates the first through the third partition plates 110 through 112. The first distribution path 31 has one end coupled to the first region having the first void ratio $\alpha_1$ (=0.2) and the other end connected to the first chamber 113. The second distribution path 32 penetrates the second and the third partition plates 111 and 112. The second distribution path 32 has one end coupled to the second region having the second void ratio $\alpha_2$ (=0.4) and the other end coupled to the second chamber 114. The third distribution path 33 penetrates or is formed in the third partition plate 112. The third distribution path 33 has one end coupled to the third region having the third void ratio $\alpha_3$ (=0.8) and the other end coupled to the third chamber 115. In this embodiment, the first, the second, and the third distribution paths 31, 32, and 33 have inner sectional areas substantially equal to one another.

Figure 7:
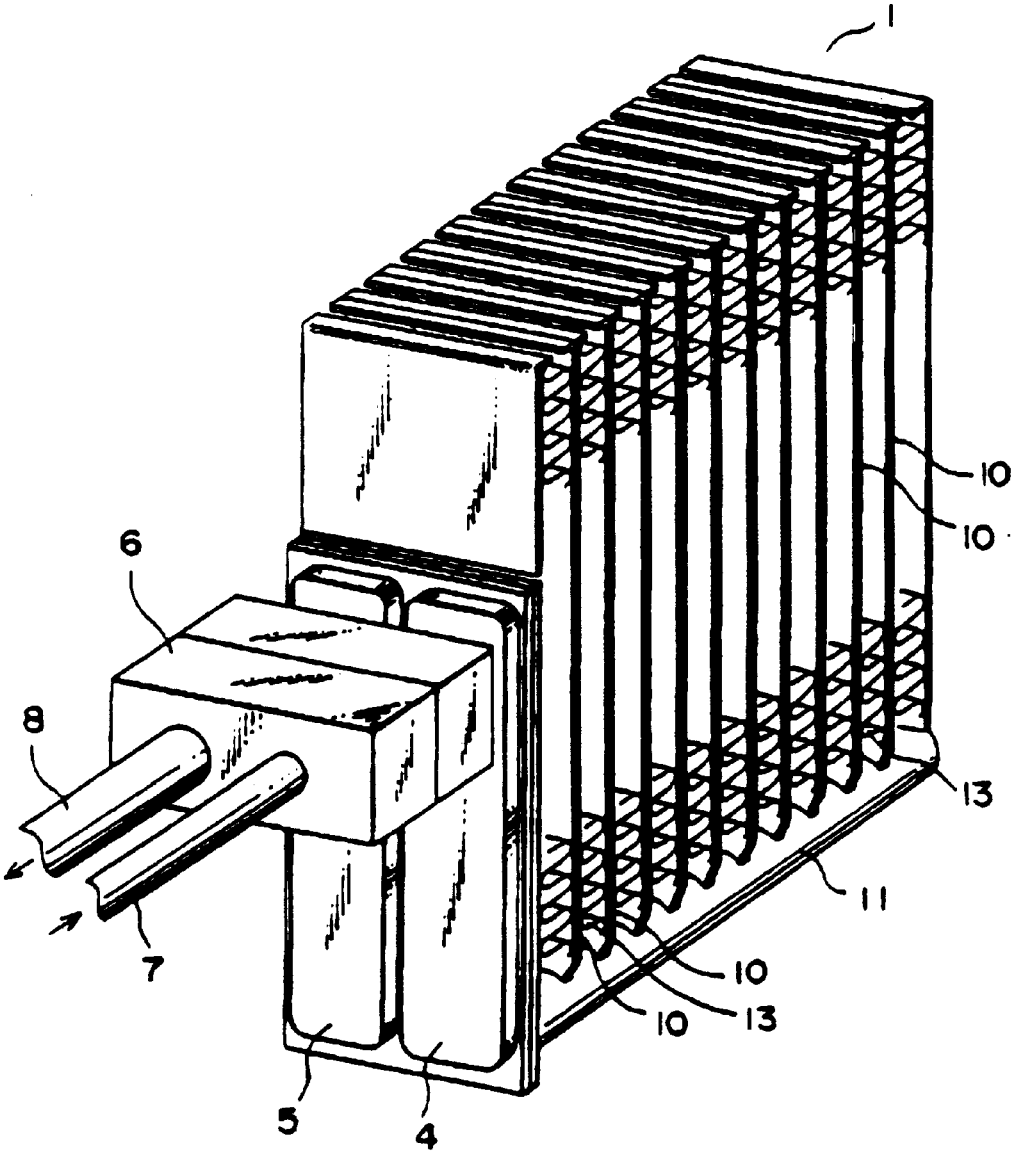
FIG. 7 is a perspective view of the heat exchanger illustrated in FIG. 5.

Referring to FIG. 7, the heat exchanger 1 is provided at its one side with the refrigerant introduction tank 4, a refrigerant discharge tank 5, a throttle unit 6, an inlet pipe 7, and an outlet pipe 8. The refrigerant introduction tank 4 has an upper end coupled to the throttle unit 6 and a lower end coupled to the entrance tank 11. The refrigerant discharge tank 5 has a lower end coupled to the exit tank and an upper end coupled to the outlet pipe 8. The throttle unit 6 is connected to the inlet pipe 7.

In this embodiment, let the total mass flow of the refrigerant be represented by G (kg/h). The inner sectional areas of the first through the third distribution paths 31, 32, and 33 are represented by $AP_1$, $AP_2$, and $AP_3$, respectively. The total inner sectional area $AP_0$ of the first through the third distribution paths 31, 32, and 33 is given by $AP_0=AP_1+AP_2+AP_3$. The numbers of the tubes in the first through the third tube groups are represented by $N_1$, $N_2$, and $N_3$, respectively. The first through the third void ratios of the first through the third regions in the distribution tank 30 are represented by $\alpha_1$, $\alpha_2$, and $\alpha_3$, respectively, as already mentioned in conjunction with FIG. 6.

Now, consideration will be made about the mass flow per each tube. At first, the tubes 10 in the first tube group communicate with the first distribution path 31 coupled to the first region having the first void ratio of $\alpha_1$ (=0.2). Each tube 10 in the first tube group is supplied with the mass flow $g_1$ (kg/h) which is given by:

$$\begin{aligned} g_1 &= G\times(AP_1/AP_0)\times(1/\alpha_1)\times(1/N_1) \\ &= G\times(AP_1/AP_0)\times(1/0.2)\times(1/8) \\ &= G\cdot AP_1/1.6AP_0. \end{aligned} \tag{1}$$

Likewise, the tubes 10 in the second and the third tube groups communicate with the second and the third distribution paths 32 and 33 coupled to the second and the third regions having the second and the third void ratios $\alpha_2$ (=0.4) and $\alpha_3$ (=0.8), respectively. Each tube 10 in the second and the third tube groups is supplied with the mass flow $g_2$ (kg/h) and $g_3$ (kg/h) which are calculated in the similar manner as:

$$g_2=G\cdot AP_2/1.6AP_0 \text{ and} \tag{2}$$

$$g_3=G\cdot AP_3/1.6AP_0. \tag{3}$$

As described above, the following relationship is held in this embodiment:

$$AP_1=AP_2=AP_3. \tag{4}$$

From Equations (1) through (4):

$$g_1=g_2=g_3.$$

Thus, an equal mass flow of the medium is supplied to every individual tube 10 in the first through the third tube groups.

In this invention, the mass flow of the medium supplied to each exchanger tube is rendered equal or uniform. It is noted here that the mass flow of the medium supplied to each tube need not be completely equal in the strict sense. It is sufficient that the mass flow supplied to each tube is generally equal as far as the heat exchanger efficiency is not significantly affected. Thus, it is essential that the mass flow of the medium supplied to each tube is substantially equal or uniform.

Figure 9:
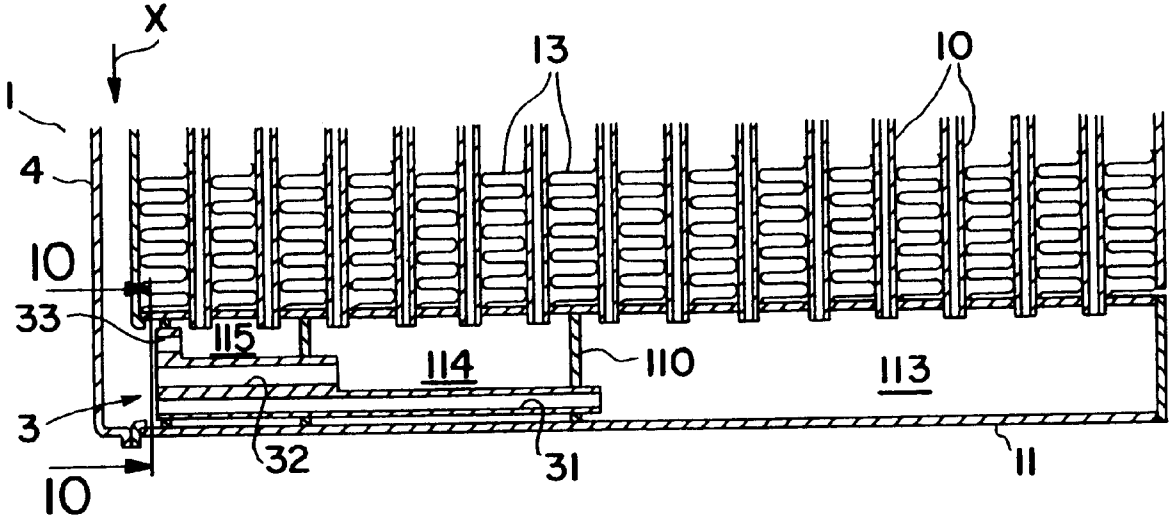
FIG. 9 is a sectional view of a heat exchanger according to a second embodiment of this invention.
Figure 10:
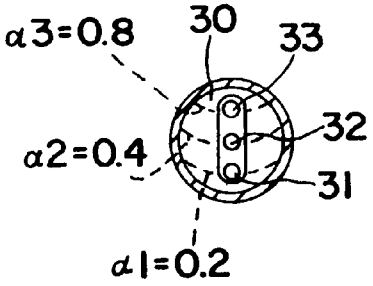
FIG. 10 is a sectional view taken along a line B—B in FIG. 9.

Referring to FIGS. 9 and 10, a heat exchanger according to a second embodiment of this invention will be described. This embodiment is substantially similar to the first embodiment except that the structure of the first through the third distribution paths. Similar parts are designated by like reference numerals and will not be described any longer.

In the first embodiment, the first and the second distribution paths 31 and 32 are implemented by pipes while the third distribution path 33 is implemented by a hole. The first through the third distribution paths 31 through 33 are separately formed. On the other hand, in this embodiment, the first through the third distribution paths 31 through 33 are integrally formed by cutting an extrusion-molded product. However, the numbers of the tubes in the first through the third tube groups connected to the first through the third chambers 113 through 115 as well as the inner sectional areas of the first through the third distribution paths 31 through 33 are identical to those specified in the first embodiment.

Figure 11:
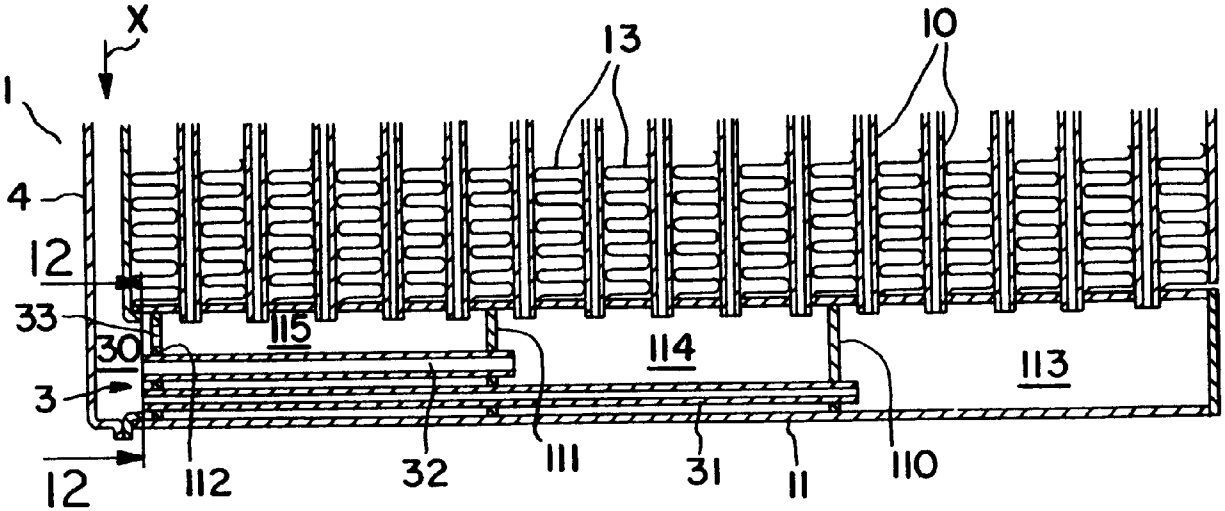
FIG. 11 is a sectional view of a heat exchanger according to a third embodiment of this invention.
Figure 12:
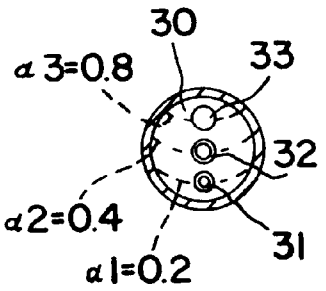
FIG. 12 is a sectional view taken along a line C—C in FIG. 11.

Referring to FIGS. 11 and 12, a heat exchanger according to a third embodiment of this invention will be described. This embodiment is substantially similar to the first embodiment except the following. Similar parts are designated by like reference numerals and will not be described any longer.

In this embodiment, the number of the tubes 10 is equal to fifteen in total. The entrance tank 11 is divided by the partition plates 110 through 112 into the first through the third chambers of an equal dimension. Therefore, the numbers of the tubes 10 in the first through the third tube groups connected to the first through the third chambers 113 through 115 are equal to each other, namely, five. In this structure, in order to uniformly supply the medium to the respective tubes 10, the inner sectional areas of the first through the third distribution paths 31 through 33 must be different from one another. In this embodiment, the inner sectional areas $AP_1$, $AP_2$, and $AP_3$ of the first through the third distribution paths 31 through 33 have the relationship represented by:

$$AP_1=AP_2/2=AP_3/4.$$

In the manner similar to that mentioned in Conjunction with the first embodiment, the total mass flow of the refrigerant is represented by G (kg/h). The total inner sectional area $AP_0$ of the first through the third distribution paths 31, 32, and 33 is given by $AP_0=AP_1+AP_2+AP_3$. The number of the tubes in each of the first through the third tube groups is represented by N. The first through the third void ratios of the first through the third regions in the distribution tank 30 are represented by $\alpha_1$, $\alpha_2$, and $\alpha_3$, respectively.

Now, consideration will be made about the mass flow per each tube. At first, the tubes 10 in the first tube group communicate with the first distribution path 31 coupled to the first region having the first void ratio of $\alpha_1$ (=0.2). Each tube 10 in the first tube group is supplied with the mass flow $g_1$ (kg/h) which is given by:

$$\begin{aligned} g_1 &= G\times(AP_1/AP_0)\times(1/\alpha_1)\times(1/N_1) \\ &= G\times(AP_1/AP_0)\times(1/0.2)\times(1/5) \\ &= G\cdot AP_1/AP_0. \end{aligned} \tag{5}$$

Likewise, the tubes 10 in the second and the third tube groups communicate with the second and the third distribution paths 32 and 33 coupled to the second and the third regions having the second and the third void ratios $\alpha_2$ (=0.4) and $\alpha_3$ (=0.8), respectively. Each tube 10 in the second and the third tube groups is supplied with the mass flow $g_2$ (kg/h) and $g_3$ (kg/h) which are calculated in the similar manner as:

$$g_2=G\cdot AP_2/2AP_0 \text{ and} \tag{6}$$

$$g_3=G\cdot AP_3/4AP_0. \tag{7}$$

As described above, the following relationship is held in this embodiment:

$$AP_1=AP_2/2=AP_3/4. \tag{8}$$

From Equations (5) through (8):

$$g_1=g_2=g_3.$$

Thus, an equal mass flow of the medium is supplied to every individual tube 10 in the first through the third tube groups.

Figure 13:
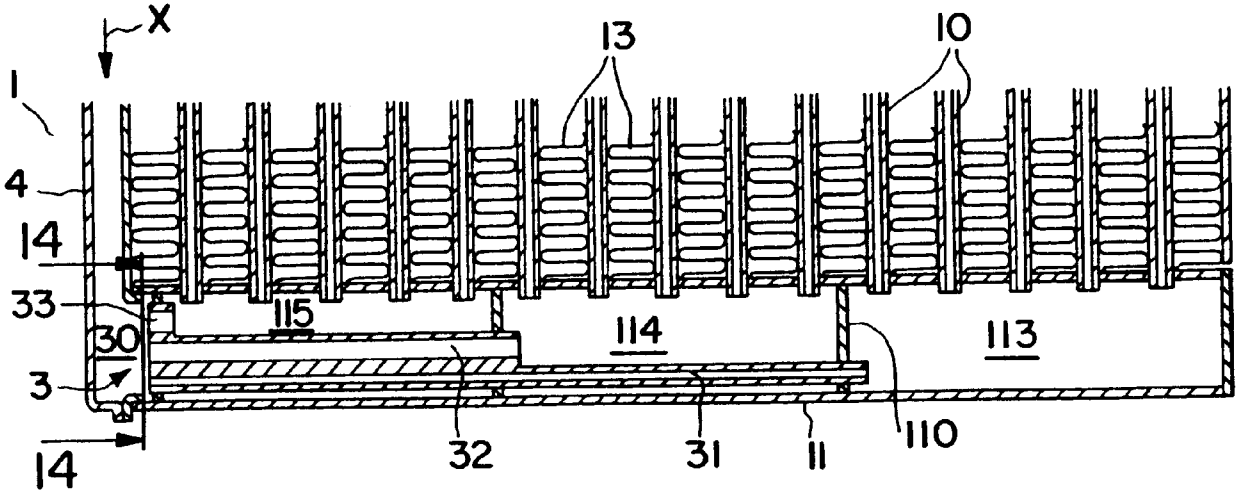
FIG. 13 is a sectional view of a heat exchanger according to a fourth embodiment of this invention.
Figure 14:
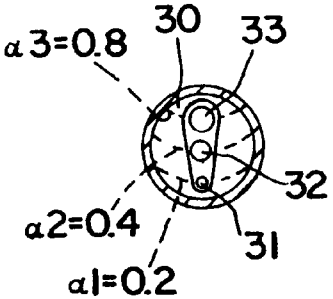
FIG. 14 is a sectional view taken along a line D—D in FIG. 13.

Referring to FIGS. 13 and 14, a heat exchanger according to a fourth embodiment of this invention will be described. This embodiment is substantially similar to the third embodiment except that the structure of the first through the third distribution paths. Similar parts are designated by like reference numerals and will not be described any longer.

In the third embodiment, the first and the second distribution paths 31 and 32 are implemented by pipes while the third distribution path 33 is implemented by a hole. The first through the third distribution paths 31 through 33 are separately formed. On the other hand, in this embodiment, the first through the third distribution paths 31 through 33 are integrally formed by cutting an extrusion-molded product. However, the numbers of the tubes in the first through the third tube groups connected to the first through the third chambers 113 through 115 as well as the inner sectional areas of the first through the third distribution paths 31 through 33 are identical to those specified in the third embodiment.

Although the number of the chambers in the entrance tank is equal to three in the first through the fourth embodiments, the entrance tank may be divided into a different number of the chambers, namely, at least equal to two.

The first through the fourth embodiments have been described in conjunction with a stacked heat exchanger of a drawn cup type. However, this invention is applicable not only to the heat exchanger of the type described but also to various types of heat exchangers with a tank and tubes through which the refrigerant flows.

As described above, according to this invention, it is possible to uniformly distribute the medium to a plurality of the tubes of the heat exchanger. As a result, the temperature distribution in the heat exchanger is suppressed so that the efficiency of the heat exchanger can be improved.

While this invention has thus far been described in conjunction with a few embodiments thereof, it will readily possible for those skilled in the art to put this invention into practice in various other manners. In each of FIGS. 5, 9, 11, and 13, the number of distribution paths 31, 32, and 33 coupled to each region is not restricted to one but may be a plural number. In other words, at least one of the first through the third distribution paths 31, 32, and 33 may comprise a plurality of partial distribution paths which have partial medium inlet ports coupled to a corresponding one of the first through the third regions ($\alpha_1$=0.2, $\alpha_2$=0.4 and $\alpha_3$=0.8) of the distribution tank 30 in common and partial medium outlet ports coupled to a corresponding one of the first through the third tube groups (113, 114, and 115) in common. In this case, a total sum of inner cross-sectional areas of the plurality of partial distribution paths is substantially equal to the inner cross-sectional area of the above-mentioned at least one of the first through the M-th distribution paths.

What is claimed is:

1. A heat exchanger (1) comprising:

first through M-th tube groups, each tube group comprising at least one exchanger tube (10), where M represents an integer greater than one; and a distribution device (3) comprising a distribution tank (30) supplied with a mixed-phase medium consisting essentially of a gas-phase medium and a liquid-phase medium, and first through M-th distribution paths (31, 32, and 33) for directing said mixed-phase medium from said distribution tank to said first through said M-th tube groups, each of said first through said M-th distribution paths having a medium inlet port and a medium outlet port; wherein:

the medium inlet ports of said first through said M-th distribution paths are coupled to first through M-th regions of said distribution tank, respectively, said first through said M-th regions containing a medium having first through M-th void ratios, respectively, which are different from each other, where each void ratio is defined as a ratio of the volume of the gas-phase medium present in each region of said distribution tank to the volume of both the gas-phase medium and the liquid-phase medium present in each region of said distribution tank;

the medium outlet ports of said first through said M-th distribution paths being coupled to the exchanger tubes of said first through said M-th tube groups, respectively;

the number of exchanger tubes in each of said first through said M-th tube groups and an inner cross-sectional area of each of said first through said M-th distribution paths defined on the basis of the first through M-th void ratios of said first through M-th regions of said distribution tank, such that when said heat exchanger is provided with said mixed-phase medium, a mass flow of said mixed-phase medium in each exchanger tube is substantially equal.

2. A heat exchanger as claimed in claim 1, said heat exchanger further comprising an exchanger entrance tank (11), wherein:

said exchanger entrance tank comprises first through M-th chambers (113, 114, and 115) which are divided by partitions (110, 111, and 112) and coupled to said first through said M-th tube groups, respectively; and the medium outlet ports of said first through said M-th distribution paths being coupled to said first through said M-th chambers, respectively.

3. A heat exchanger as claimed in claim 1, wherein the number of the exchanger tubes of an M-th tube group increases inverse proportionally to an m-th void ratio of an m-th region when the inner cross-sectional areas of said first through said M-th distribution paths area substantially equal to each other, where m is variable between 1 and M, both inclusive.

4. A heat exchanger as claimed in claim 1, wherein the inner cross-sectional area of an m-th distribution path increases in direct proportion with an m-th void ratio of an m-th region when the number of the exchanger tubes in each of said first through said M-th tube groups is substantially equal, where m is variable between 1 and M, both inclusive.

5. A heat exchanger as claimed in claim 1, wherein:

the number of the exchanger tubes of an m-th tube group and the inner cross-sectional area of an m-th distribution path is defined in accordance with an expression:

$$g=G\times(AP_m/AP_0)\times(1/\alpha_m)\times(1/N_m),$$

where g represents the mass flow of said mixed-phase medium introduced into each of the exchanger tubes of said first through said M-th tube groups; G represents a total mass flow of said mixed-phase medium introduced into the exchanger tubes of said first through said M-th tube groups; $AP_m$ represents the inner cross-sectional area of said m-th distribution path; $AP_0$ represents a total sum of the inner cross-sectional areas of said first through said M-th distribution paths; $\alpha_m$ represents an m-th void ratio of an m-th region; $N_m$ represents the number of the exchanger tubes of said m-th tube group; and where m is variable between 1 and M, both inclusive.

6. A heat exchanger as claimed in claim 1, wherein at least one of said first through said M-th distribution paths comprises a plurality of partial distribution paths which have partial medium inlet ports coupled to a corresponding one of said first through said M-th regions of said distribution tank in common and partial medium outlet ports coupled to a corresponding one of said first through said M-th tube groups in common, a total sum of inner cross-sectional areas of said plurality of partial distribution paths being substantially equal to the inner cross-sectional area of said at least one of said first through said M-th distribution paths.

7. The heat exchanger of claim 1, wherein said heat exchanger is substantially vertical.

* * * * *